US005439739A

United States Patent [19]

Furukawa et al.

[11] Patent Number: 5,439,739

[45] Date of Patent: Aug. 8, 1995

[54] INK JET RECORDING MEDIUM

[75] Inventors: Akira Furukawa; Makoto Kato, both of Tokyo, Japan

[73] Assignee: Mitsubishi Paper Mills Limited, Tokyo, Japan

[21] Appl. No.: 251,842

[22] Filed: Jun. 1, 1994

[30] Foreign Application Priority Data

Jun. 3, 1993 [JP] Japan ..... 5-133151
Jun. 3, 1993 [JP] Japan ..... 5-133152

[51] Int. Cl.[6] ..... B41M 5/00

[52] U.S. Cl. ..... 428/341; 347/105; 428/195; 428/211; 428/342; 428/413; 428/474.4; 428/500

[58] Field of Search ..... 347/105; 428/195, 211, 428/341, 342, 413, 474.4, 500

[56] References Cited

U.S. PATENT DOCUMENTS 3,928,697 12/1975 Mallinson et al. ..... 428/142
4,371,582 2/1984 Sugiyama et al. ..... 428/341
4,830,911 5/1989 Kojima et al. ..... 428/342

*Primary Examiner*—Pamela R. Schwartz
*Attorney, Agent, or Firm*—Armstrong, Westerman, Hattori, McLeland & Naughton

[57] ABSTRACT

An ink jet recording medium capable of providing recorded images of excellent water resistance which is obtained by coating on a support a mixture of 100 parts by weight of a water-soluble polymer and 0.1–30 parts by weight of a crosslinking agent such as an epoxy or triazine crosslinking agent, said water-soluble polymer being obtained by copolymerizing 10–50 parts by weight of a quaternary salt monomer selected from tri-methyl-3-(acryloylamino)propylammonium chloride, trimethyl-2-(methacryloyloxy)ethylammonium chloride, etc., 1–30 parts by weight of an amino group-containing monomer selected from dimethylaminopropylacrylamide, dimethylaminoethyl methacrylate, etc. or a carboxyl group-containing monomer selected from acrylic acid, methacrylic acid, etc., and 20–80 parts by weight of a monomer selected from acrylamide, 2-hydroxyethyl (meth)acrylate, N-vinylpyrrolidone, etc.

4 Claims, No Drawings

INK JET RECORDING MEDIUM

BACKGROUND OF THE INVENTION

1. Field of the Invention

The present invention relates to an ink jet recording medium to which an aqueous ink is applied for carrying out recording. More particularly, it relates to a recording medium which is suitable for use to carry out color image recording thereon with an aqueous ink and which comprises a paper, a resin coated paper or a film as a support.

2. Related Art

The ink jet recording method performs recording of letters or images by allowing ink droplets ejected by various working principles on a recording medium. Ink jet printers have such favorable features that there is no limitation as to kind of recording patterns, that they can easily perform multi-color recording and that the maintenance thereof is easy. Therefore, the ink jet printers are rapidly becoming widespread as devices for producing hard copies of image information. The image information recorded on ink jet recording media which comprise a transparent film as a support is utilized as originals for presentation in conferences, lecture meetings, etc. by using overhead projectors together with photographic slides. Recording of image information by ink jet recording method for overhead projectors provides many merits.

As for the recording media used for ink jet recording, efforts have been made from the aspects of printer hardwares or ink composition in order to use woodfree papers or coated papers used for ordinary printing or writing. However, improvements in recording media have come to be required increasingly in order to go side by side with developments in printer hardwares such as ever increasing speed, development of ever finer definition and images of full color. That is, for recording media, it is required that image density of the printed ink dots be high and hue characteristics be bright and appealing, the ink absorbing capacity be great and the ink absorbing speed be high and as a result, the ink applied do not bleed or spread even though different color inks are put over additionally. Moreover, the circumference of dots should be sharp and demarcating. In order to meet these requirements, many proposals have been made. For example, Japanese Patent Kokai No.53-49113 discloses an ink jet recording sheet containing urea-formaldehyde resin powder and impregnated with a water-soluble polymer, but the ink jet recording sheets of this type suffer from the problems that the circumference of dots is apt to get blurred and besides, density of dots is low.

Further, Japanese Patent Kokai No.55-5830 discloses an ink jet recording sheet comprising a support and an ink absorbing coating layer provided thereon; Japanese Patent Kokai No.55-51583 discloses to use an amorphous silica powder as a pigment in the coating layer; and Japanese Patent Kokai Nos.59-174381, 60-44389, 60-132785 and 60-171143 disclose ink jet recording sheets which have a transparent ink-receiving layer. These ink jet recording media of coated paper type are improved over the ink jet recording sheets of plain paper type in dot diameter, shape of dots and image density, but are still insufficient in the ink absorbing speed. Especially, when dots of a plurality of aqueous inks overlap in multi-color recording, there sometimes occur the problems that the inks spread or the inks transfer to the guide roll of printing devices owing to insufficient drying of inks or insufficient absorption of inks to cause staining of the recorded images.

On the other hand, as to the ink jet recording media comprising a transparent support on which image information used for overhead projectors is recorded, ink absorbing inorganic pigment cannot be used in a large amount because use of the pigment generally damages transparency and in many cases, the ink absorbability depends on the properties of the resin layer formed on the surface of the transparent support. Examples of the resins conventionally used for this purpose are polyvinyl pyrrolidone and polyvinyl pyrrolidone-vinyl acetate copolymer disclosed in Japanese Patent Kokai No. 57-38185, copolymers of polyvinyl alcohol and olefins or styrene and maleic anhydride disclosed in Japanese Patent Kokai No. 60-234879, crosslinking products of polyethylene oxide and isocyanate compounds disclosed in Japanese Patent Kokai No.61-74879, blends of carboxymethyl cellulose and polyethylene oxide disclosed in Japanese Patent Kokai No.61-181679, and grafted polymers of methacrylamide on polyvinyl alcohol disclosed in Japanese Patent Kokai No.61-132377.

In all of the above methods, when a number of ink dots are printed on the surface of a recording medium at a high speed as in the case of high speed multi-color recording, the ink absorbing speed and the ink absorbing capacity are both insufficient and there are serious problems on quality of recorded images such as spread of dots, unevenness in color or density caused by blending of inks between adjacent dots and unevenness in solid print portions. Furthermore, since the recorded image is insufficient in water resistance, there are another problems that the ink dye bleeds due to deposition of waterdrops and the surface of the recording medium is dissolved with water.

SUMMARY OF THE INVENTION

The object of the present invention is to solve the above problems and the object has been accomplished by the following ink jet recording medium. That is, the recording medium comprises a support such as a paper, an RC paper (a paper laminated with polyethylene on one or both sides), a light transmitting support, for example, a polyester sheet, a film support or the like and at least one ink-receiving layer provided on the support, an image being formed on the ink-receiving layer using an aqueous ink containing a water-soluble dye. The ink jet recording medium is characterized in that said ink-receiving layer contains a water-soluble polymer which is obtained by copolymerizing 10–50 parts by weight of at least one monomer selected from the quaternary salt monomers represented by the following formulas (I), (II) and (III), 1–30 parts by weight of at least one monomer selected from the monomers represented by the following formulas (IV), (V), (VI) and (VII), and 20–80 parts by weight of at least one monomer selected from acrylamide, methacrylamide, N,N-dimethylacrylamide, N-isopropylacrylamide, diacetone acrylamide, N-methylolacrylamide, 2-hydroxyethyl (meth)acrylate and N-vinylpyrrolidone as a water-soluble monomer and in that the recording medium is obtained by coating on said support a mixture comprising 100 parts by weight of said water-soluble polymer and 0.1–30 parts by weight of a crosslinking agent for curing the water-soluble polymer and drying the coat.

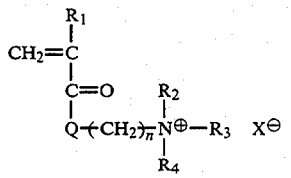

(I)

(wherein $R_1$ represents hydrogen or a methyl group, Q represents oxygen or an NH group, $R_2$, $R_3$ and $R_4$ each represents a methyl group or an ethyl group and may be the same or different, X represents a halogen ion, a sulfonate ion, an alkylsulfonate ion, an acetate ion or an alkylcarboxylate ion, and n represents an integer of 2 or 3);

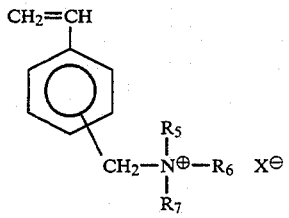

(II)

(wherein $R_5$, $R_6$ and $R_7$ each represents a methyl group or an ethyl group and may be the same or different and X is as defined above);

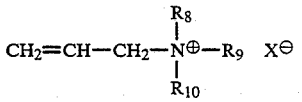

(III)

(wherein $R_8$, $R_9$ and $R_{10}$ each represents a methyl group, an ethyl group or an allyl group and may be the same or different and X is as defined above);

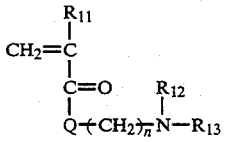

(IV)

(wherein $R_{11}$ represents hydrogen or a methyl group, $R_{12}$ and $R_{13}$ each represents a methyl group or an ethyl group and may be the same or different, Q represents oxygen or an NH group, and n represents an integer of 2 or 3);

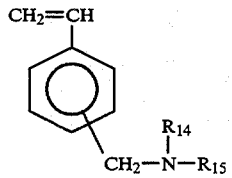

(V)

(wherein $R_{14}$ and $R_{15}$ each represents hydrogen atom, a methyl group or an ethyl group and may be the same or different);

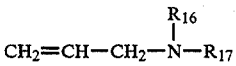

(VI)

(wherein $R_{16}$ and $R_{17}$ each represents hydrogen atom, a methyl group, an ethyl group or an allyl group and may be the same or different);

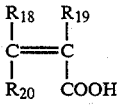

(VII)

(wherein $R_{18}$ and $R_{19}$ each represents hydrogen or a methyl group and may be the same or different and $R_{20}$ represents hydrogen or a carboxylic acid group).

DESCRIPTION OF THE INVENTION

In the construction of the water-soluble polymer, it is characterized that the monomers selected from those represented by the formulas (I), (II) and (III) are quaternary salts. By introducing 10–50 parts by weight of such monomer component into the polymer composition, the solubility of the resulting polymer in water can be improved and in addition, fixability of ink jet recording ink and water resistance can also be improved.

That is, for general ink jet recording inks, acid dyes having sulfonic acid group and food dyes which are good in water-solubility are mainly used. It is considered that when a polymer having a quaternary salt group is present on a recording medium, the polymer chemically bonds to the dye due to counter ion exchanging. As a result, the action to enhance fixability or water resistance of recorded images can be exhibited.

The amount of the quaternary salt type monomer selected from those represented by the formulas (I), (II) and (III) and introduced as a comonomer into the above water-soluble polymer must be in the range of 10–50 parts by weight. If the amount is less than 10 parts by weight, fixability of the dye contained in the ink is insufficient and the image readily disappears when washed with water. If it exceeds 50 parts by weight, hygroscopicity of the coating film formed of the water-soluble polymer is very high to result in the problems that the surface of the film becomes tacky or blocking of the surface occurs.

Of the monomers represented by the formulas (I), (II) and (III), preferred are, for example, trimethyl-2-(methacryloyloxy)ethylammonium chloride, triethyl-2-(methacryloyloxy)ethylammonium chloride, trimethyl-2-(acryloyloxy)ethylammonium chloride, triethyl-2-(acryloyloxy)ethylammonium chloride, trimethyl-3-(methacryloyloxy)propylammonium chloride, triethyl-3-(methacryloyloxy)propylammonium chloride, trimethyl-2-(methacryloylamino)ethylammonium chloride, triethyl-2-(methacryloylamino)ethylammonium chloride, trimethyl-2-(acryloylamino)ethylammonium chloride, triethyl-2-(acryloylamino)ethylammonium chloride, trimethyl-3-(methacryloylamino)propylammonium chloride, triethyl-3-(methacryloylamino)-propylammonium chloride, trimethyl-3-(acryloylamino)propylammonium chloride, triethyl-3-(acryloylamino)propylammonium chloride, N,N-dimethyl-N-ethyl-2-(methacryloyloxy)ethylammonium chloride, N,N-diethyl-N-methyl-2-(methacryloyloxy)-ethylammonium chloride, N,N-dimethyl-N-ethyl-3-(acryloylamino)propylammonium chloride, trimethyl- 2-(methacryloyloxy)ethylammonium bromide, trimethyl-3-(acryloylamino)propylammonium bromide, trimethyl-2-(methacryloyloxy)ethylammonium sulfonate, trimethyl-3-(acryloylamino)propylammonium acetate, trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-dimethyl-N-ethyl-p-vinylbenzylammonium chloride, N,N-diethyl-N-methyl-p-vinylbenzylammonium chloride, trimethyl-p-vinylbenzylammonium bromide, trimethyl-m-vinylbenzylammonium bromide, trimethyl-p-vinylbenzylammonium sulfonate, trimethyl-m-vinylbenzylammonium sulfonate, trimethyl-p-vinylbenzylammonium acetate, trimethyl-m-vinylbenzylammonium acetate, diallyldimethylammonium chloride, diallyldiethylammonium chloride, diallyldimethylammonium bromide, diallyldimethylammonium sulfonate, and diallyldimethylammonium acetate. These may be used each alone or in combination.

Furthermore, by introducing the amino group-containing monomer selected from those represented by the formulas (IV), (V) and (VI) in an amount of 1–30 parts by weight into the water-soluble polymer, the fixability of the dye contained in the ink can be further enhanced and the dye is fixed in the vicinity of the surface and therefore, image density increases and simultaneously the shape of ink dots which form the image can be made uniform and the unevenness in solid print portion can be inhibited.

If the amount of the monomer selected from those represented by the formulas (IV), (V) and (VI) in the water-soluble polymer is less than 1 part by weight, the function to enhance the fixability of the dye contained in the ink cannot be recognized and such defects as occurrence of unevenness in the solid print portions are often brought about. If the amount is more than 30 parts by weight, the interaction with the dye is too strong, resulting in change of color tone and deterioration of color reproducibility.

When the ink-receiving layer contains the water-soluble polymer containing 1–30 parts by weight of the monomer component selected from those represented by the formulas (IV)–(VI), it is especially preferred to use a crosslinking agent together with the water-soluble polymer because it cures the water-soluble polymer thereby markedly enhancing the water resistance of recorded image and simultaneously blocking can be inhibited, tackiness of the surface can be removed and besides, absorbing speed and absorbing capacity for ink can be increased. The amino group-containing monomers represented by the formulas (IV)–(VI) are functional groups which serve as reaction sites for the crosslinking agent. In synthesis of copolymers using the monomers represented by the formulas (IV)–(VI), neutralization may be carried out using inorganic acids or organic acids for adjustment of pH, but preferably the monomers are not completely neutralized and some amino groups are left in a free state to retain the reactivity with the crosslinking agent. When the ink-receiving layer is formed using the water-soluble polymer without the crosslinking agent, water resistance of the ink-receiving layer per se cannot be obtained and the desired ink jet recording medium of the present invention excellent in water resistance cannot be obtained.

Preferable examples of the monomers represented by the formulas (IV)–(VI) are N,N-dimethylaminoethyl (meth)acrylate, N,N-diethylaminoethyl (meth)acrylate, and N,N-dimethylaminopropylacrylamide.

Further, by introducing the monomer having carboxyl group represented by the formula (VII) in an amount of 1–30 parts by weight into the water-soluble polymer, a reaction site for the crosslinking agent can be given to the polymer, and when a coating film is formed by adding a crosslinking agent together with the water-soluble polymer, an ink-receiving layer excellent in water resistance can be formed with proceeding of the crosslinking reaction. Preferable nonlimiting examples of the monomers are acrylic acid, methacrylic acid, crotonic acid, maleic acid, itaconic acid and fumaric acid.

If the amount of the monomer represented by the formula (VII) in the water-soluble polymer is less than 1 part by weight, the degree of crosslinking effected by the crosslinking agent is insufficient and a coating film excellent in water resistance cannot be formed. If the amount is more than 30 parts by weight, the effect to fix the ink by the quaternary salt group, namely, the fixability of the dye in the ink-receiving layer is damaged due to the increase of anionic property caused by carboxyl group and as a result, the dye is easily washed away with water. This is not preferred.

When the ink-receiving layer contains the water-soluble polymer containing 1–30 parts by weight of the monomer component represented by the formulas (VII), it is especially preferred to use a crosslinking agent together with the water-soluble polymer because it cures the water-soluble polymer thereby markedly enhancing the water resistance of recorded image and simultaneously blocking can be inhibited, tackiness of the surface can be removed and besides, absorbing speed and absorbing capacity for ink can be increased. The compounds of the formulas (IV)–(VII) can be used each alone or in combination.

As the crosslinking agents used in the present invention, compounds of epoxy type, triazine type, azidine type, vinyl sulfone type and active ester type can be used advantageously. Among them, the compounds of epoxy type and triazine type are especially preferred in practicality.

Preferable examples of the epoxy type crosslinking agents are the following exemplified compounds Nos. 1–9 and those of the triazine type cross-linking agents are the following compound Nos.10 and 11.

Exemplified Compound No. 1

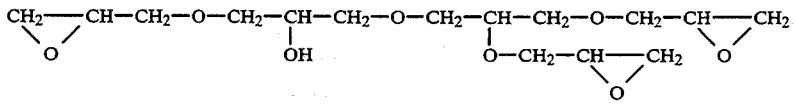

Exemplified Compound No. 2

-continued
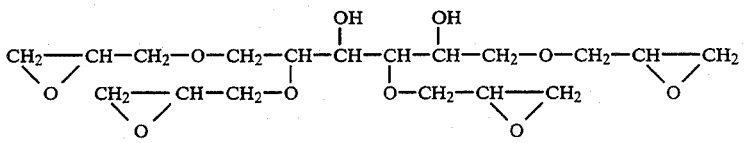
Exemplified Compound No. 3
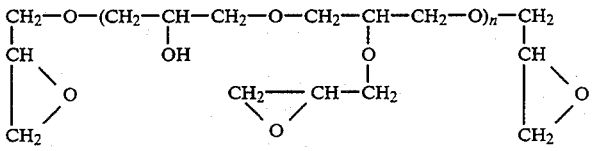
Exemplified Compound No. 4
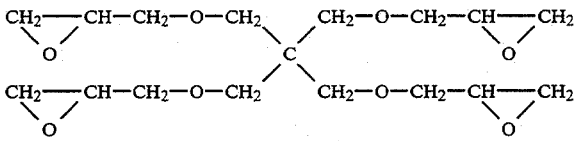
Exemplified Compound No. 5
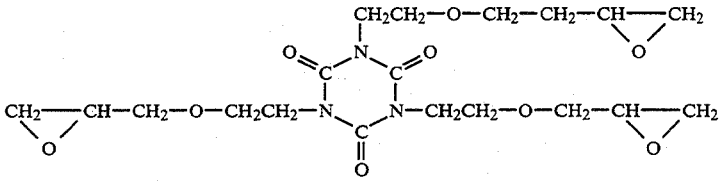
Exemplified Compound No. 6
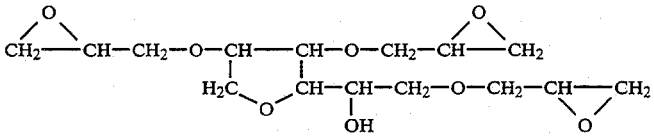
Exemplified Compound No. 7
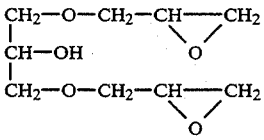
Exemplified Compound No. 8
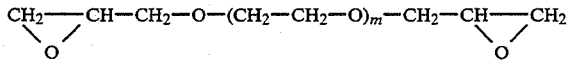
(m is an integer of 1–22.)
Exemplified Compound No. 9
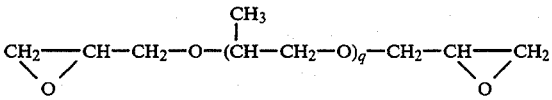
(q is an integer of 1–11.)
Exemplified Compound No. 10
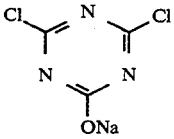
Exemplified Compound No. 11

-continued

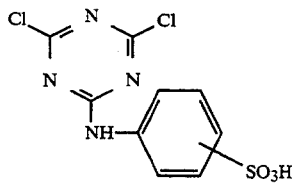

The amount of these epoxy or triazine type crosslinking agents for the water-soluble polymer is preferably in the range of 0.1–30 parts by weight for 100 parts by weight of the water-soluble polymer. If it is less than the above range, crosslinking of the water-soluble polymer film per se which forms the ink-receiving layer containing the crosslinking agent is insufficient and water resistance of the film is insufficient and in addition, blocking is apt to occur. If the amount of the crosslinking agent is more than 30 parts by weight, a polymer film having a sufficient water resistance can be formed, but ink is absorbed with difficulty and unabsorbed ink stains the guide rolls of ink jet recording devices and furthermore, quality of the printed image is seriously deteriorated.

When a mixture of the water-soluble polymer and the crosslinking agent as a coating liquid is coated on a support such as a paper, a film or the like and dried, it is preferred to carry out the drying at a temperature of 50°–130° C. If the drying temperature is lower than this range, the crosslinking reaction of the water-soluble polymer with the crosslinking agent does not proceed and if it is higher than 130° C., side reactions other than the crosslinking reaction take place, which sometimes cause coloration of the coating film. Furthermore, if necessary, after being dried, the coating film is further left to stand for several days to one week at a temperature higher than room temperature thereby allowing the crosslinking reaction to proceed to a further complete extent. This is preferred.

It is necessary that as the third component to be introduced into the water-soluble polymer, at least one monomer selected from acrylamide, methacrylamide, N,N-dimethylacrylamide, N-isopropylacrylamide, diacetone acrylamide, N-methylolacrylamide, 2-hydroxyethyl (meth)acrylate and N-vinylpyrrolidone in an amount of 20–80 parts by weight is copolymerized as a comonomer into the water-soluble polymer. The introduction of the comonomer exhibits the preferable action to enhance the ink absorbability of the coating film formed, especially the absorbability for alcohols such as glycerin, isopropyl alcohol and diethylene glycol and other organic solvents which are usually added to inks. Furthermore, the introduction of the comonomer exerts very effective actions such as decrease of tackiness of the film, inhibition of blocking, proper adjustment of dot diameter of the print images, increase in uniformity of the solid print portion, improvement in sharpness of the image, and improvement in gloss of printed image and surface gloss. If the amount of the third component in the water-soluble polymer is less than 20 parts by weight, the above preferable actions are exhibited with difficulty and if it is more than 80 parts by weight, fixability of the dye in the ink is damaged and the above actions are not exerted.

The object of the present invention can be achieved by introducing the water-soluble polymer having the above-mentioned composition, but it is also preferred to introduce various other monomers in addition to those referred to hereabove as comonomers, thereby to exhibit printing characteristics in correspondence to the characteristics of the ink jet recording devices used. These other monomers include, for example, alkyl (meth)acrylate esters, styrene-sulfonates, styrene, allylsulfonates, methallyl-sulfonates and vinyl acetate are used. These monomers can be used depending on the purpose irrespective of hydrophilic nature or hydrophobic nature of the monomers per se.

The object of the present invention such as improvement of print quality and enhancement of water resistance of recorded images can be attained by coating the water-soluble polymer solution alone on a support such as paper, film or the like to form the ink-receiving layer. However, it is also possible to use other various water-soluble polymers, latexes, surface active agents, inorganic pigments, polymer particles and other additives in admixture with the water-soluble polymer of the present invention or in separate layers. These additives may be contained not in the coating liquid, but in a pulp slurry used for making the support paper.

For example, water-soluble polymers such as polyvinyl alcohol, starch, carboxymethyl cellulose, cationized gelatin, cationized polyvinyl alcohol, and cationized starch are mixed with the water-soluble polymer of the present invention and the mixture can be used as a coating liquid. Furthermore, for various purposes, to the ink-receiving layer can be added latexes such as acrylic latexes, SBR latexes and polyvinyl acetate latexes, surface active agents such as polyalkylene oxides, inorganic pigments such as alumina sol and cationic colloidal silica, and polymer particles such as micron-size polystyrene fine particles.

When the water-soluble polymer of the present invention is used as a coating liquid, amount of the water-soluble polymer in the ink-receiving layer formed on the surface of the support is preferably 0.1–20 g/m$^2$ in terms of solid content and the coating amount of 0.1 g/m$^2$ or more gives good ink absorbability. When the coating amount exceeds 20 g/m$^2$, the function as an ink-receiving layer undergoes no change, but curling of recording medium sometimes occurs.

As the water-soluble polymers disclosed in the present invention, the copolymers having the compositions as aforementioned are used preferably, but such polymers as containing one of the comonomer component as a graft chain can also be used preferably. For example, in the presence of a water-soluble polymer formed by copolymerizing 10–50 parts by weight of a monomer component selected from those of the formulas (I)–(III) and 1–30 parts by weight of a monomer component selected from those of the formulas (IV)–(VII), 20–80 parts by weight of the above-mentioned monomer such as acrylamide, methacrylamide or the like as a third component is polymerized to form a graft polymer. Alternatively, a graft polymer can also be synthesized by previously synthesizing a macro-monomer from either one of the monomer components and copolymerizing this macro-monomer with other monomers. The composition of the backbone and branch components in the graft polymer can be in various combinations. By using such graft polymer, wettability of the surface of ink-receiving layer with ink can be properly controlled and the diameter of dots can be controlled to preferable size. This is preferred. The graft polymer can be used alone or together with the copolymer and the above-mentioned various additives such as various water-soluble polymers, latexes, surface active agents, inorganic pigments and polymer fine particles.

The inks used for printing using the ink jet recording material of the present invention are not limitative as far as they are aqueous inks, but preferred are those which contain acid dyes or food dyes for sufficiently ensuring the water resistance of the recorded images.

The present invention will be explained in more detail by the following examples.

Synthesis Example 1

40 g of trimethyl-3-(acryloylamino)propylammonium chloride (monomer of the formula (I)), 10 g of dimethylaminopropylacrylamide (monomer of the formula (IV)) and 50 g of acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.) with stirring under heating for 4 hours on a water bath to obtain a colorless and viscous polymer solution.

Synthesis Example 2

30 g of trimethyl-3-(acryloylamino)propylammonium chloride, 10 g of dimethylaminopropylacrylamide and 60 g of N-vinylpyrrolidone were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.) with stirring under heating for 4 hours on a water bath to obtain a colorless and viscous polymer solution.

Synthesis Example 3

35 g of trimethyl-3-(acryloylamino)propylammonium chloride, 10 g of dimethylaminopropylacrylamide and 55 g of N,N-dimethylacrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.) with stirring under heating for 4 hours on a water bath to obtain a colorless and viscous polymer solution.

Synthesis Example 4

35 g of trimethyl-3-(acryloylamino)propylammonium chloride, 10 g of dimethylaminopropylacrylamide and 55 g of 2-hydroxyethyl methacrylate were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Synthesis Example 5

35 g of trimethyl-3-(acryloylamino)-propylammonium chloride, 10 g of dimethylaminopropylacrylamide and 55 g of diacetone acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Synthesis Example 6

35 g of trimethyl-3-(acryloylamino)-propylammonium chloride, 10 g of dimethylaminopropylacrylamide and 55 g of methacrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Synthesis Example 7

35 g of trimethyl-2-(methacryloyloxy)-ethylammonium chloride (monomer of the formula (I)), 10 g of dimethylaminoethyl methacrylate (monomer of the formula (IV)) and 55 g of acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was adjusted to pH 8 with 2N aqueous hydrochloric acid solution under cooling and then, stirred on a water bath of 50° C. in a nitrogen atmosphere. The polymerization was initiated by adding 0.9 g of V-50 (2,2'-azobis(2-methyl-propionamidine) dihydrochloride manufactured by Wako Jun-yaku Co., Ltd.), followed by stirring under heating for 4 hours on a water bath to obtain a colorless and viscous polymer solution.

Synthesis Example 8

45 g of ethyl trimethyl-2-(methacryloyloxy)-ethylammonium chloride, 10 g of dimethylaminoethyl methacrylate and 45 g of N,N-dimethylacrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was adjusted to pH 8 with 2N aqueous hydrochloric acid solution under cooling and then, stirred on a water bath of 50° C. in a nitrogen atmosphere. The polymerization was initiated by adding 0.9 g of V-50 (2,2'-azobis(2-methyl-propionamidine) dihydrochloride manufactured by Wako Jun-yaku Co., Ltd.), followed by stirring under heating for 4 hours on a water bath to obtain a colorless and viscous polymer solution.

Synthesis Example 9

40 g of trimethyl-2-(methacryloyloxy)-ethylammonium chloride, 10 g of dimethylaminoethyl methacrylate and 50 g of diacetone acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was adjusted to pH 8 with 2N aqueous hydrochloric acid solution under cooling and then, stirred on a water bath of 50° C. in a nitrogen atmosphere. The polymerization was initiated by adding 0.9 g of V-50 (2,2'-azobis(2-methyl-propionamidine) dihydrochloride manufactured by Wako Jun-yaku Co., Ltd.), followed by stirring under heating for 4 hours on a water bath to obtain a colorless and viscous polymer solution.

Synthesis Example 10

40 g of dimethyldiallylammonium chloride (monomer of the formula (III)), 10 g of allylamine (monomer of the formula (VI)) and 50 g of diacetone acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was adjusted to pH 8 with 2N aqueous hydrochloric acid solution under cooling and then, stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Synthesis Example 11

40 g of 4-vinylbenzyltrimethylammonium chloride (monomer of the formula (II)), 10 g of diethylaminomethylstyrene (monomer of the formula (V)) and 50 g of diacetone acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was adjusted to pH 8 with 2N aqueous hydrochloric acid solution under cooling and then, stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Comparative Synthesis Example 1

80 g of trimethyl-3-(acryloylamino)propylammonium chloride and 20 g of acrylamide were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Comparative Synthesis Example 2

60 g of trimethyl-3-(acryloylamino)propylammonium chloride, 30 g of a neutralization product of N,N-dimethylaminoethyl methacrylate with hydrochloric acid and 10 g of N-vinylpyrrolidone were charged in a 1 liter four-necked flask equipped with a thermometer, a stirrer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding 0.9 g of V-50 (2,2'-azobis(2-methylpropionamidine) dihydrochloride manufactured by Wako Jun-yaku Co., Ltd.), followed by stirring under heating for 4 hours on a water bath to obtain a colorless and viscous polymer solution.

Example 1

To each of the polymer solutions obtained in Synthesis Examples 1–11 in an amount of 10 parts by weight in terms of solid content was added 1 part by weight of Denacol EX-521 (Exemplified Compound No. 3 (n=3) manufactured by Nagase Kasei Kogyo Co., Ltd.) as an epoxy crosslinking agent to prepare a solution of 12% by weight in total solid concentration. The solution was adjusted to pH 8.0 to obtain a coating liquid. This coating liquid was coated at a dry film thickness of 10 microns on a PET film provided with an aqueous subbing layer of 100 microns thick and dried with heating in a dryer adjusted to 75° C. for 3 hours. Printing was carried out on the resulting sheet using an ink jet printer Picsel Jet manufactured by Canon, Inc. to obtain the results as shown in Tables 1 and 2. The image density was evaluated on the images of black (Bk), yellow (Y), magenta (M) and cyan (C).

Example 2

Example 1 was repeated except that the dichlorotriazine sodium salt of the Exemplified Compound No. 10 was used in place of the epoxy crosslinking agent, thereby to obtain the same good results.

Example 3

To each of the polymer solutions obtained in Synthesis Examples 1–11 in an amount of 10 parts by weight in solid content was added 1 part by weight of Denacol EX-512 (Exemplified Compound No. 3 (n=2) manufactured by Nagase Kasei Kogyo Co., Ltd.) as an epoxy crosslinking agent to prepare a solution of 12% by weight in total solid concentration. Thereto were added 0.08 part by weight of Newcol 707 (manufactured by Nippon Nyukazai Co., Ltd.) as a polyethylene glycol surface active agent and 0.02 part by weight of monodispersed polystyrene fine particles of 5 microns as a matting agent and the solution was adjusted to pH 8.0 to prepare a coating liquid. This coating liquid was coated at a dry film thickness of 12 microns on an RC paper comprising a paper laminated with polyethylene and dried in a dryer adjusted to 75° C. for 3 hours. Printing was carried out on the resulting sheet using an ink jet printer Picsel Jet manufactured by Canon, Inc. to obtain the results as shown in Tables 3 and 4.

Comparative Example 1

To each of the polymer solutions obtained in Comparative Synthesis Examples 1 and 2 in an amount of 10 parts by weight in solid content was added distilled water to prepare a solution of 12% by weight in total solid concentration. The solution was adjusted to pH 8.0 to obtain a coating liquid. This coating liquid was coated at a dry film thickness of 10 microns on a PET film provided with an aqueous subbing layer of 100 microns thick and dried in a dryer adjusted to 75° C. for 3 hours. Printing was carried out on the resulting sheet using an ink jet printer Picsel Jet manufactured by Canon, Inc. to obtain the results as shown in Tables 1 and 2.

Comparative Example 2

To each of the polymer solutions obtained in Comparative Synthesis Examples 1 and 2 in an amount of 10 parts by weight in solid content was added distilled water to prepare a solution of 12% by weight in total solid concentration. To the solution were added 0.08 part by weight of Newcol 707 (Nippon Nyukazai Co., Ltd.) as a polyethylene glycol surface active agent and 0.02 part by weight of monodispersed polystyrene fine particles of 5 microns as a matting agent. The solution was adjusted to pH 8.0 to obtain a coating liquid. This coating liquid was coated at a dry film thickness of 12 microns on an RC paper comprising a paper laminated with polyethylene and dried in a dryer adjusted to 75° C. for 3 hours. Printing was carried out on the resulting sheet using an ink jet printer Picsel Jet manufactured by Canon, Inc. to obtain the results as shown in Tables 3 and 4.

TABLE 1

| Sample | Image density Bk | Y | M | C | Uniformity of solid print portion | Water resistance |
|---|---|---|---|---|---|---|
| Synthesis Example 1 | 1.30 | 1.30 | 1.35 | 1.40 | ○ | ○ |
| Synthesis Example 2 | 1.25 | 1.28 | 1.30 | 1.35 | ○ | ○ |
| Synthesis Example 3 | 1.28 | 1.30 | 1.30 | 1.37 | ○ | ○ |
| Synthesis Example 4 | 1.30 | 1.31 | 1.30 | 1.40 | ○ | ○ |
| Synthesis Example 5 | 1.25 | 1.30 | 1.22 | 1.30 | ○ | ○ |
| Synthesis Example 6 | 1.20 | 1.25 | 1.32 | 1.33 | ○ | ○ |
| Synthesis Example 7 | 1.22 | 1.23 | 1.32 | 1.30 | ○ | ○ |
| Synthesis Example 8 | 1.24 | 1.25 | 1.28 | 1.31 | ○ | ○ |
| Synthesis Example 9 | 1.33 | 1.28 | 1.33 | 1.28 | ○ | ○ |
| Synthesis Example 10 | 1.25 | 1.25 | 1.28 | 1.25 | ○ | ○ |
| Synthesis Example 11 | 1.30 | 1.28 | 1.31 | 1.34 | ○ | ○ |
| Comparative Synthesis Example 1 | 1.10 | 1.11 | 1.20 | 1.16 | X | X |
| Comparative Synthesis Example 2 | 1.08 | 1.05 | 1.12 | 1.15 | X | X |

In Table 1, the water resistance was evaluated in the following manner. That is, the printed samples were dipped in a warm water of 40° C. and when the printed image did not change, these samples are shown by "○" and other samples are shown by "x". The uniformity of solid portion was evaluated in the following manner. That is, a solid image of each color was printed and the degree of uniformity of the printed image was visually inspected. When uniform solid image was printed on the sheet, these samples are shown by "○" and other samples are shown by "x".

TABLE 2

| Sample | Ink absorbability | Blocking | Dot reproducibility |
|---|---|---|---|
| Synthesis Example 1 | ○ | ○ | ○ |
| Synthesis Example 2 | ○ | ○ | ○ |
| Synthesis Example 3 | ○ | ○ | ○ |
| Synthesis Example 4 | ○ | ○ | ○ |
| Synthesis Example 5 | ○ | ○ | ○ |
| Synthesis Example 6 | ○ | ○ | ○ |
| Synthesis Example 7 | ○ | ○ | ○ |
| Synthesis Example 8 | ○ | ○ | ○ |
| Synthesis Example 9 | ○ | ○ | ○ |
| Synthesis Example 10 | ○ | ○ | ○ |
| Synthesis Example 11 | ○ | ○ | ○ |
| Comparative Synthesis Example 1 | X | X | X |
| Comparative Synthesis Example 2 | X | X | X |

In Table 2, the ink absorbability was evaluated in the following manner. That is, the image just after printed was touched by finger and when the ink dried and did not transfer to the finger, this is shown by "○" and when the ink transferred to the finger, this is shown by "x". The blocking was evaluated in the following manner. That is, the samples before or after subjected to printing were put together and left to stand in a room adjusted to 35° C. and 80% in humidity for 24 hours. When the samples put together adhered to each other, this is shown by "x" and when the samples did not adhere to each other and easily separated from each other, this is shown by "○". The dot reproducibility was evaluated by the diameter of dots and the circumferential sharpness of dots when the printed dots were observed under a light microscope.

When change in dot diameter occurred due to the spread of ink between the adjacent dots or when color density in the dot had light and shade portions, this is shown by "x" and when dots showed less spread and had uniform diameter and color tone, this is shown by "○".

TABLE 3

| Sample | Image density Bk | Y | M | C | Uniformity of solid print portion | Water resistance |
|---|---|---|---|---|---|---|
| Synthesis Example 1 | 1.35 | 1.31 | 1.33 | 1.38 | ○ | ○ |
| Synthesis Example 2 | 1.35 | 1.30 | 1.33 | 1.40 | ○ | ○ |
| Synthesis Example 3 | 1.30 | 1.28 | 1.28 | 1.36 | ○ | ○ |
| Synthesis Example 4 | 1.29 | 1.30 | 1.30 | 1.38 | ○ | ○ |
| Synthesis Example 5 | 1.30 | 1.30 | 1.35 | 1.40 | ○ | ○ |
| Synthesis Example 6 | 1.35 | 1.28 | 1.33 | 1.40 | ○ | ○ |
| Synthesis Example 7 | 1.30 | 1.30 | 1.28 | 1.38 | ○ | ○ |
| Synthesis Example 8 | 1.28 | 1.28 | 1.25 | 1.35 | ○ | ○ |
| Synthesis Example 9 | 1.30 | 1.30 | 1.38 | 1.38 | ○ | ○ |
| Synthesis Example 10 | 1.28 | 1.32 | 1.35 | 1.38 | ○ | ○ |
| Synthesis Example 11 | 1.30 | 1.30 | 1.35 | 1.40 | ○ | ○ |
| Comparative Synthesis Example 1 | 1.15 | 1.18 | 1.20 | 1.20 | X | X |
| Comparative Synthesis Example 2 | 1.18 | 1.20 | 1.20 | 1.15 | X | X |

In Table 3, the water resistance and the uniformity in solid portions were evaluated in the same manner as in Table 1.

TABLE 4

| Sample | Ink absorbability | Blocking | Dot reproducibility |
|---|---|---|---|
| Synthesis Example 1 | ○ | ○ | ○ |
| Synthesis Example 2 | ○ | ○ | ○ |
| Synthesis Example 3 | ○ | ○ | ○ |
| Synthesis Example 4 | ○ | ○ | ○ |
| Synthesis Example 5 | ○ | ○ | ○ |
| Synthesis Example 6 | ○ | ○ | ○ |
| Synthesis Example 7 | ○ | ○ | ○ |
| Synthesis Example 8 | ○ | ○ | ○ |
| Synthesis Example 9 | ○ | ○ | ○ |
| Synthesis Example 10 | ○ | ○ | ○ |
| Synthesis Example 11 | ○ | ○ | ○ |
| Comparative Synthesis Example 1 | X | X | X |
| Comparative Synthesis Example 2 | X | X | X |

In Table 4, the ink absorbability, the blocking and the dot reproducibility were evaluated in the same manner as in Table 2.

Synthesis Example 12

40 g of trimethyl-3-(acryloylamino)propylammonium chloride (monomer of the formula (I), DMAPAA-Q manufactured by Kojin Co., Ltd.), 10 g of acrylic acid (monomer of the formula (VII)) and 50 g of acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 13

45 g of trimethyl-3-(acryloylamino)propylammonium chloride (DMAPAA-Q manufactured by Kojin Co., Ltd.), 10 g of methacrylic acid (monomer of the formula (VII)) and 45 g of diacetone acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 14

35 g of trimethyl-3-(acryloylamino)propylammonium chloride (DMAPAA-Q manufactured by Kojin Co., Ltd.), 8 g of methacrylic acid and 57 g of N,N-dimethylacrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 15

35 g of trimethyl-3-(acryloylamino)propylammonium chloride (DMAPAA-Q manufactured by Kojin Co., Ltd.), 15 g of methacrylic acid and 50 g of N-vinylpyrrolidone were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. A 2N aqueous sodium hydroxide solution was added dropwise to adjust pH of the solution to 7.0 and the solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 16

45 g of trimethyl-3-(acryloylamino)-propylammonium chloride (DMAPAA-Q manufactured by Kojin Co., Ltd.), 5 g of methacrylic acid and 50 g of 2-hydroxyethyl methacrylate were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 17

45 g of trimethyl-2-(methacryloyloxy)-ethylammonium chloride (monomer of the formula (I)), 5 g of methacrylic acid and 50 g of acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 18

40 g of trimethyl-2-(methacryloyloxy)ethylammonium chloride, 10 g of methacrylic acid and 50 g of N,N-dimethylacrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 19

40 g of trimethyl-2-(methacryloyloxy)-ethylammonium chloride, 10 g of methacrylic acid, 30 g of N,N-dimethylacrylamide and 20 g of diacetone acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 20

40 g of diallyldimethylammonium chloride (monomer of the formula (III)), 10 g of methacrylic acid, 20 g of N,N-dimethylacrylamide and 30 g of acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Synthesis Example 21

42 g of 4-vinylbenzyltrimethylammonium chloride (monomer of the formula (II)), 8 g of methacrylic acid, 30 g of N,N-dimethylacrylamide and 20 g of 2-hydroxyethyl methacrylate were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Comparative Synthesis Example 3

80 g of trimethyl-3-(acryloylamino)propylammonium chloride (DMAPAA-Q manufactured by Kojin Co., Ltd.) and 20 g of acrylamide were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Comparative Synthesis Example 4

50 g of trimethyl-3-(acryloylamino)propylammonium chloride (DMAPAA-Q manufactured by Kojin Co., Ltd.) and 50 g of N-vinylpyrrolidone were charged in a 1 liter four-necked flask equipped with a stirrer, a thermometer, a nitrogen introducing pipe and a reflux condenser and furthermore, 200 g of distilled water and 100 g of ethanol were added thereto to dissolve the monomers. The solution was stirred on a water bath of 50° C. in a nitrogen atmosphere. The polymerization was initiated by adding thereto 0.9 g of V-50 (2,2'-azobis(2-methylpropionamidine) dihydrochloride manufactured by Wako Jun-yaku Co., Ltd.), followed by stirring with heating for 4 hours on a water bath to obtain a colorless and viscous polymer solution.

Example 4

To each of the polymer solutions obtained in Synthesis Examples 12–21 in an amount of 10 parts by weight in solid content was added 1 part by weight of Denacol EX-521 (Exemplified Compound No.3. (n=3) manufactured by Nagase Kasei Kogyo Co., Ltd.) as an epoxy crosslinking agent to prepare a solution of 12% by weight in total solid concentration. The solution was adjusted to pH 8.0 to obtain a coating liquid. This coating liquid was coated at a dry thickness of 10 microns on a PET film provided with an aqueous subbing layer of 100 microns thick and dried in a dryer adjusted to 75° C. for 3 hours. Printing was carried out on the resulting sheet using an ink jet printer Picsel Jet manufactured by Canon, Inc. to obtain the results as shown in Tables 5 and 6. The image density was evaluated on the images of black (Bk), yellow (Y), magenta (M) and cyan (C).

Example 5

Example 4 was repeated except that the hydroxydichlorotriazine sodium salt of the Exemplified Compound No.10 was used in place of the epoxy crosslinking agent, thereby to obtain the same good results.

Example 6

To each of the polymer solutions obtained in Synthesis Examples 12–21 in an amount of 10 parts by weight in solid content was added 1 part by weight of Denacol EX-512 (Exemplified Compound No.3 (n=2) manufactured by Nagase Kasei Kogyo Co., Ltd.) as an epoxy crosslinking agent to prepare a solution of 12% by weight in total solid concentration. Thereto were added 0.08 part by weight of Newcol 707 (manufactured by Nippon Nyukazai Co., Ltd.) as a polyethylene glycol surface active agent and 0.02 part by weight of monodispersed polystyrene fine particles of 5 microns as a matting agent and the solution was adjusted to pH 8.0 to obtain a coating liquid. This coating liquid was coated at a dry film thickness of 12 microns on an RC paper comprising a paper laminated with polyethylene and dried in a dryer adjusted to 75° C. for 3 hours. Printing was carried out on the resulting sheet using an ink jet printer Picsel Jet manufactured by Canon, Inc. to obtain the results as shown in Tables 7 and 8.

Comparative Example 3

To each of the polymer solutions obtained in Comparative Synthesis Examples 3 and 4 in an amount of 10 parts by weight in solid content was added distilled water to prepare a solution of 12% by weight in total solid concentration. The solution was adjusted to pH 8.0 to obtain a coating liquid. This coating liquid was coated at a dry film thickness of 10 microns on a PET film provided with an aqueous subbing layer of 100 microns thick and dried in a dryer adjusted to 75° C. for 3 hours. Printing was carried out on the resulting sheet using an ink jet printer Picsel Jet manufactured by Canon, Inc. to obtain the results as shown in Tables 5 and 6.

Comparative Example 4

To each of the polymer solutions obtained in Comparative Synthesis Examples 3 and 4 in an amount of 10 parts by weight in solid content was added distilled water to prepare a solution of 12% by weight in total solid concentration. To the solution were added 0.08 part by weight of Newcol 707 (Nippon Nyukazai Co., Ltd.) as a polyethylene glycol surface active agent and 0.02 part by weight of monodispersed polystyrene fine particles of 5 microns as a matting agent. The solution was adjusted to pH 8.0 to obtain a coating liquid. This coating liquid was coated at a dry film thickness of 12 microns on an RC paper comprising a paper laminated with polyethylene and dried in a dryer adjusted to 75° C. for 3 hours. Printing was carried out on the resulting sheet using an ink jet printer Picsel Jet manufactured by Canon, Inc. to obtain the results as shown in Tables 7 and 8.

TABLE 5

| Sample | Image density Bk | Y | M | C | Uniformity of solid print portion | Water resistance |
|---|---|---|---|---|---|---|
| Synthesis Example 12 | 1.32 | 1.25 | 1.30 | 1.35 | ○ | ○ |
| Synthesis Example 13 | 1.25 | 1.30 | 1.25 | 1.30 | ○ | ○ |
| Synthesis Example 14 | 1.28 | 1.30 | 1.30 | 1.37 | ○ | ○ |
| Synthesis Example 15 | 1.30 | 1.30 | 1.30 | 1.38 | ○ | ○ |
| Synthesis Example 16 | 1.26 | 1.28 | 1.29 | 1.32 | ○ | ○ |
| Synthesis Example 17 | 1.22 | 1.29 | 1.32 | 1.34 | ○ | ○ |
| Synthesis Example 18 | 1.21 | 1.25 | 1.28 | 1.30 | ○ | ○ |

TABLE 5-continued

| Sample | Image density Bk | Y | M | C | Uniformity of solid print portion | Water resistance |
|---|---|---|---|---|---|---|
| Synthesis Example 19 | 1.25 | 1.25 | 1.25 | 1.28 | ○ | ○ |
| Synthesis Example 20 | 1.30 | 1.30 | 1.28 | 1.30 | ○ | ○ |
| Synthesis Example 21 | 1.25 | 1.25 | 1.28 | 1.25 | ○ | ○ |
| Comparative Synthesis Example 3 | 1.15 | 1.18 | 1.20 | 1.20 | X | X |
| Comparative Synthesis Example 4 | 1.18 | 1.20 | 1.20 | 1.15 | X | X |

In Table 5, the water resistance was evaluated in the following manner. That is, the printed samples were dipped in a warm water of 40° C. and when the printed image did not change, these samples are shown by "○" and other samples are shown by "x". The uniformity of solid portion was evaluated in the following manner. That is, a solid image of each color was printed and the degree of uniformity of the printed image was visually inspected. When uniform solid image was printed on the sheet, these samples are shown by "○" and other samples are shown by "x".

TABLE 6

| Sample | Ink absorbability | Blocking | Dot reproducibility |
|---|---|---|---|
| Synthesis Example 12 | ○ | ○ | ○ |
| Synthesis Example 13 | ○ | ○ | ○ |
| Synthesis Example 14 | ○ | ○ | ○ |
| Synthesis Example 15 | ○ | ○ | ○ |
| Synthesis Example 16 | ○ | ○ | ○ |
| Synthesis Example 17 | ○ | ○ | ○ |
| Synthesis Example 18 | ○ | ○ | ○ |
| Synthesis Example 19 | ○ | ○ | ○ |
| Synthesis Example 20 | ○ | ○ | ○ |
| Synthesis Example 21 | ○ | ○ | ○ |
| Comparative Synthesis Example 3 | X | X | X |
| Comparative Synthesis Example 4 | X | X | X |

In Table 6, the ink absorbability was evaluated in the following manner. That is, the image just after printed was touched by finger and when the ink dried and did not transfer to the finger, this is shown by "○" and when the ink transferred to the finger, this is shown by "x". The blocking was evaluated in the following manner. That is, the samples before or after subjected to printing were put together and left to stand in a room adjusted to 35° C. and 80% in humidity for 24 hours. When the samples adhered to each other, this is shown by "x" and when the samples did not adhere to each other and easily separated from each other, this is shown by "○". The dot reproducibility was evaluated by the diameter of dots and the circumferential sharpness of dots when the printed dots were observed under a light microscope.

When change in dot diameter occurred due to the spread of ink between the adjacent dots or when color density in the dot had light and shade portions, this is shown by "x" and when dots showed less spread and had uniform diameter and color tone, this is shown by "○".

TABLE 7

| Sample | Image density Bk | Y | M | C | Uniformity of solid print portion | Water resistance |
|---|---|---|---|---|---|---|
| Synthesis Example 12 | 1.32 | 1.30 | 1.30 | 1.34 | ○ | ○ |
| Synthesis Example 13 | 1.31 | 1.32 | 1.30 | 1.30 | ○ | ○ |
| Synthesis Example 14 | 1.30 | 1.30 | 1.29 | 1.35 | ○ | ○ |
| Synthesis Example 15 | 1.25 | 1.25 | 1.28 | 1.30 | ○ | ○ |
| Synthesis Example 16 | 1.30 | 1.30 | 1.31 | 1.35 | ○ | ○ |
| Synthesis Example 17 | 1.32 | 1.28 | 1.35 | 1.40 | ○ | ○ |
| Synthesis Example 18 | 1.32 | 1.30 | 1.30 | 1.39 | ○ | ○ |
| Synthesis Example 19 | 1.30 | 1.28 | 1.30 | 1.35 | ○ | ○ |
| Synthesis Example 20 | 1.30 | 1.30 | 1.38 | 1.38 | ○ | ○ |
| Synthesis Example 21 | 1.28 | 1.28 | 1.30 | 1.34 | ○ | ○ |
| Comparative Synthesis Example 3 | 1.15 | 1.15 | 1.20 | 1.20 | X | X |
| Comparative Synthesis Example 4 | 1.13 | 1.10 | 1.15 | 1.20 | X | X |

In Table 7, the water resistance and the uniformity in solid portions were evaluated in the same manner as in Table 5.

TABLE 8

| Sample | Ink absorbability | Blocking | Dot reproducibility |
|---|---|---|---|
| Synthesis Example 12 | ○ | ○ | ○ |
| Synthesis Example 13 | ○ | ○ | ○ |
| Synthesis Example 14 | ○ | ○ | ○ |
| Synthesis Example 15 | ○ | ○ | ○ |
| Synthesis Example 16 | ○ | ○ | ○ |
| Synthesis Example 17 | ○ | ○ | ○ |
| Synthesis Example 18 | ○ | ○ | ○ |
| Synthesis Example 19 | ○ | ○ | ○ |
| Synthesis Example 20 | ○ | ○ | ○ |
| Synthesis Example 21 | ○ | ○ | ○ |
| Comparative Synthesis Example 3 | X | X | |
| Comparative Syntesis Example 3 | X | X | X |

In Table 8, the ink absorbability, the blocking and the dot reproducibility were evaluated in Table 6.

According to the present invention, there can be obtained an ink jet recording medium which is excellent in ink absorbability and can give printed images having good quality, namely, sharp in dots and uniform in solid portion and having markedly improved water resistance.

What is claimed is:

1. An ink jet recording medium comprising a support and at least one ink-receiving layer on which a recorded image is formed using an aqueous ink containing a water-soluble dye where said ink-receiving layer contains a water-soluble polymer obtained by copolymerizing 10–50 parts by weight of at least one monomer selected from the quaternary salt monomers represented by the following formulas (I), (II) and (III), 1–30 parts by weight of at least one monomer selected from the monomers represented by the following formulas (IV), (V), (VI) and (VII), and 20–80 parts by weight of at least one monomer selected from acrylamide, methacrylamide, N,N-dimethylacrylamide, N-isopropylacrylamide, diacetone acrylamide, N-methylolacrylamide, 2-hydroxyethyl (meth)acrylate and N-vinylpyrrolidone as a water-soluble monomer, the recording medium being obtained by coating on the support a coating liquid containing 100 parts by weight of said water-soluble polymer and 0.1–30 parts by weight of a crosslinking agent for curing the water-soluble polymer and drying the coat:

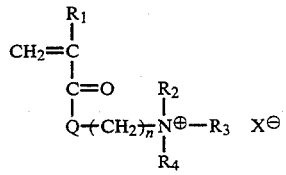

(I)

wherein $R_1$ represents a hydrogen atom or a methyl group, Q represents oxygen or an NH group, $R_2$, $R_3$ and $R_4$ each represents a methyl group or an ethyl group and may be the same or different, X represents a halogen ion, a sulfonate ion, an alkylsulfonate ion, an acetate ion or an alkylcarboxylate ion, and n represents an integer of or 3;

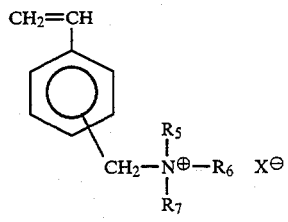

(II)

wherein $R_5$, $R_6$ and $R_7$ each represents a methyl group or an ethyl group and may be the same or different and X is as defined above;

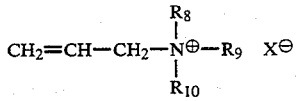

(III)

wherein $R_8$, $R_9$ and $R_{10}$ each represents a methyl group, an ethyl group or an allyl group and may be the same or different and X is as defined above;

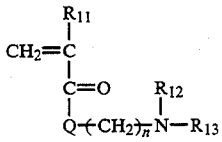

(IV)

wherein $R_{11}$ represents a hydrogen atom or a methyl group, $R_{12}$ and $R_{13}$ each represents a methyl group or an ethyl group and may be the same or different, Q represents an oxygen atom or an NH group, and n represents an integer of 2 or 3;

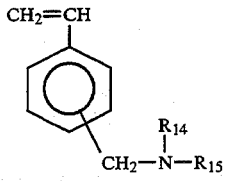

(V)

wherein $R_{14}$ and $R_{15}$ each represents a hydrogen atom, a methyl group or an ethyl group and may be the same or different;

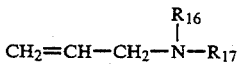

(VI)

wherein $R_{16}$ and $R_{17}$ each represents a hydrogen atom, a methyl group, an ethyl group or an allyl group and may be the same or different;

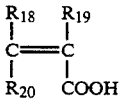

(VII)

wherein $R_{18}$ and $R_{19}$ each represents a hydrogen atom or a methyl group and may be the same or different and $R_{20}$ represents a hydrogen atom or a carboxylic acid group.

2. An ink jet recording medium according to claim 1, wherein the crosslinking agent is an epoxy compound or a triazine compound.

3. An ink jet recording medium according to claim 1, wherein amount of the water-soluble polymer in the ink-receiving layer is 0.1–20 g/m$^2$ in solid content.

4. An ink jet recording medium according to claim 1, wherein the support is paper, RC paper, light transmitting sheet or film.

* * * * *